US006461240B1

(12) United States Patent
Perkins

(10) Patent No.: US 6,461,240 B1
(45) Date of Patent: Oct. 8, 2002

(54) CARD GAME USING SPECIFIED CARD FOR SIDE BET POOL AND METHOD OF PLAYING

(76) Inventor: Thomas Francis Perkins, 6460 Chickasaw Dr., Douglasville, GA (US) 30135

( * ) Notice: Subject to any disclaimer, the term of this patent is extended or adjusted under 35 U.S.C. 154(b) by 0 days.

(21) Appl. No.: 09/480,667

(22) Filed: Jan. 11, 2000

Related U.S. Application Data

(60) Provisional application No. 60/117,390, filed on Jan. 27, 1999.

(51) Int. Cl.[7] ..... A63F 9/24

(52) U.S. Cl. ..... 463/13; 463/11

(58) Field of Search ..... 463/11, 12, 13; 273/292, 293, 303

(56) References Cited

U.S. PATENT DOCUMENTS 5,332,219 A * 7/1994 Marnell, II et al. ..... 273/138 A
5,743,800 A * 4/1998 Huard et al. ..... 463/26
5,988,643 A * 11/1999 Awada ..... 273/292
6,015,344 A * 1/2000 Kelly et al. ..... 463/16
6,073,930 A * 7/2000 Jones et al. ..... 273/292
6,139,430 A * 10/2000 Huard et al. ..... 463/16
6,146,270 A * 11/2000 Huard et al. ..... 463/12

* cited by examiner

*Primary Examiner*—Joe H. Cheng
*Assistant Examiner*—Julie Brocketti
(74) *Attorney, Agent, or Firm*—Piper Rudnick LLP; Wilburn L. Chester

(57) ABSTRACT

A game played in conjunction with card games and including an auxiliary bonus feature and method of playing. The game is playable in conjunction with standard card games, such as Poker or Blackjack, or other card games, using one or more standard decks of 52 cards or representations thereof and optionally one or more Jokers added to the deck or to each deck. The game is further playable, for example, on a gaming table by players and a dealer using cards, or on a computer, other electronic medium, or slot machine using representations of various features of the game. At the time of ante in the card game, each player participating in the card game optionally selects whether to participate in the auxiliary bonus portion of the game by making a special bonus bet, which is placed in a special bonus jackpot. Play then proceeds according to the rules of the underlying card game. A player wins the special bonus jackpot if the player has selected to participate in the auxiliary bonus portion of the game and if the player is dealt a predetermined card, such as the added Joker. If no player wins the jackpot in a particular hand, the jackpot carries over, thus providing greater incentive for player participation and continued play. If the predetermined card is dealt to a Dealer or is dealt as, for example, a community card, the predetermined card is discarded and another card dealt. The player receiving the dealt predetermined card is dealt an additional card to complete that player's hand whether or not any winning jackpot is distributed. Thus, the predetermined card, such as the Joker, is not used for play in the card game. In play with a gaming table, the table includes various spots or locations for easing play or ensuring proper play, including a location for placement of the special bonus bet by each player and betting spots for placement of bets and antes.

23 Claims, 6 Drawing Sheets

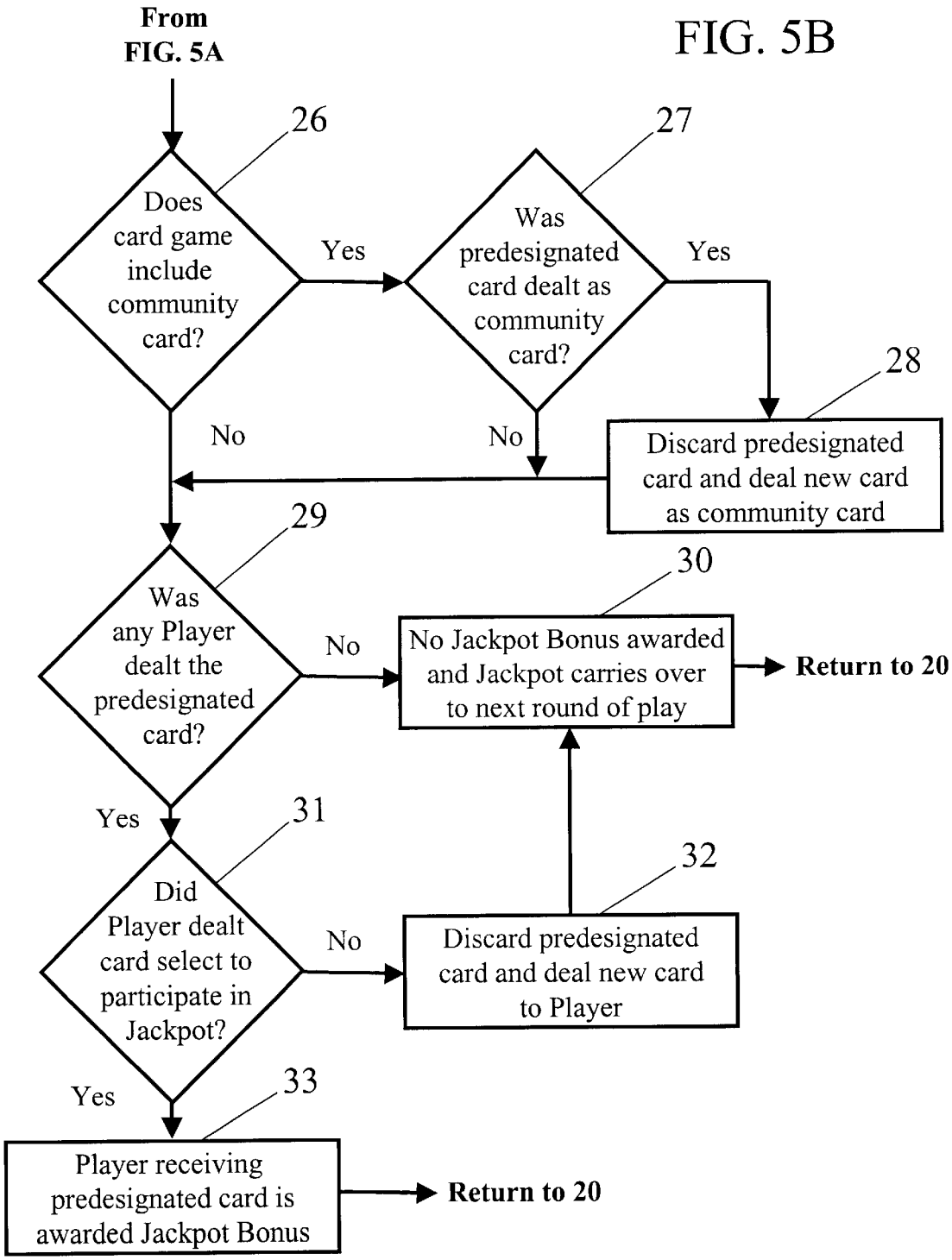
From FIG. 5A
FIG. 5B
26
Does card game include community card?
Yes
27
Was predesignated card dealt as community card?
Yes
28
Discard predesignated card and deal new card as community card
No
No
29
Was any Player dealt the predesignated card?
No
30
No Jackpot Bonus awarded and Jackpot carries over to next round of play
Return to 20
Yes
31
Did Player dealt card select to participate in Jackpot?
No
32
Discard predesignated card and deal new card to Player
Yes
33
Player receiving predesignated card is awarded Jackpot Bonus
Return to 20

CARD GAME USING SPECIFIED CARD FOR SIDE BET POOL AND METHOD OF PLAYING

This application claims priority to applicant's copending U.S. Provisional Patent Application Serial No. 60/117,390 of Thomas Francis PERKINS titled "CARD GAME USING SPECIFIED CARD FOR SIDE BET POOL" filed Jan. 27, 1999.

FIELD OF THE INVENTION

This invention relates to a game, and in particular to a card game auxiliary feature in which a participating player selecting to play a side bet portion of the game, if dealt a predetermined card wins a side bet pool.

BACKGROUND

It is known in the art to provide card games, such as Poker and Blackjack, in a casino environment or consistent with casino style rules. In these variations, the gaming establishment typically seeks to attract as many participants to a game as possible to increase the money collected at the gaming table. In addition, the number of games played during a specified time, such as the number of hands per hour, is also an important metric used to evaluate the return potential for a game. That is, the more hands that are played during a unit of time, the greater the money collected by the house and the corresponding profit realized.

In poker games, in general, high/low games are preferred, as these games keep more players in the game as both a high hand and a low hand can win, in which case the pot is split. Because the players, regardless of whether attempting to gain a high hand or a low hand, are sharing a pot, the amount of money required to stay in the game may dissuade some players from continuing play during a game. Also, splitting of the pot may be perceived by some players as not providing adequate winnings. Furthermore, these high/low games require the building of a hand to assess one's chances of winning, and, consequently, recognition that a hand may possibly win can take several cards.

There is a need for a card game having an auxiliary payoff pot that is not related to the pot for a simultaneously played base game. There is a further need for a card game having an auxiliary payoff feature that is quickly determined and does not require the building of a hand.

SUMMARY OF THE INVENTION

It is an advantage of the present invention to meet these needs, and others, by providing a card game auxiliary feature for increasing player participation and likelihood of continued play by providing a pooled bet by players, in which the pooled side bet is won by a participating player receiving a predetermined card. It is another advantage of the present invention to provide for the betting pool to carry over to subsequent hands if not won, so as to encourage continued play.

It is another advantage of the present invention for the predetermined card to be a Joker added to a standard deck of cards. It is yet another advantage of the present invention for the predetermined card to be selected at random from the deck of cards, such as by cutting the deck. It is yet another advantage of the present invention for the Joker added to the standard deck of cards not to be used in play of the card game.

It is a further advantage of the present invention to provide for the pooled bet and dealing of the predetermined winning card in conjunction with any of several underlying games. It is yet another advantage for the underlying game to be Poker, including Draw Poker, Five Card Stud Poker, and Seven Card Stud Poker. It is yet another advantage for the underlying game to be Blackjack.

The present invention comprises a casino style card game with auxiliary betting pool feature, also referred to as a side bet pool. The game, referred to as "Bonus Jackpot" is playable in conjunction with any of several standard card games, such as Poker or Blackjack, or other card games, using one or more standard decks of 52 cards or representations thereof and optionally one or more Jokers added to the deck or to each deck. The game is further playable, for example, on a gaming table by players and a dealer using cards, or on a computer, other electronic medium, slot machine, or other device using representations of various features of the game. In an embodiment of the present invention, at the time of ante in the card game, each player participating in the card game optionally selects whether to participate in the auxiliary bonus portion of the game by making a special bonus bet, which is placed in a special bonus jackpot. Play then proceeds according to the rules of the underlying card game. In an embodiment of the present invention, a player wins the special bonus jackpot if the player has selected to participate in the auxiliary bonus portion of the game and if the player is dealt a predetermined card, such as the added Joker or a card selected at random prior to start of the game, such as a card selected by cutting the deck. If no player wins the jackpot in a particular hand, the jackpot carries over, thus providing greater incentive for player participation and continued play, whether or not the player wins the underlying card game. If the predetermined card is dealt to a Dealer or is dealt as, for example, a community card, the predetermined card is discarded and another card dealt. The player receiving the dealt predetermined card is dealt an additional card to complete that player's hand whether or not any winning jackpot is distributed. Thus, the predetermined card, such as a Joker, is not used for play in the card game. In play with a gaming table, the table includes various spots or locations for easing play or ensuring proper play, including a location for placement of the special bonus bet by each player and betting spots for placement of bets and antes.

To achieve the stated and other advantages of the present invention, as embodied and described below, the invention includes a method for at least one player to play a card game with a deck of cards, the deck of cards including a predetermined jackpot card, and for the at least one player optionally to participate in jackpot play for a jackpot, comprising: receiving a selection from each of the at least one player whether to participate in the card game; receiving a selection from the each of the at least one card game player whether to participate in the jackpot play; dealing at least one card from the deck of cards to each of the at least one card game player; determining whether each of the at least one card game player participating in the jackpot play was dealt the predetermined jackpot card; and if one of the at least one card game player participating in the jackpot play was dealt the predetermined jackpot card, awarding the jackpot to the one of the at least one card game player participating in the jackpot play dealt the predetermined jackpot card.

To achieve the stated and other advantages of the present invention, as embodied and described below, the invention further includes a method for playing a card game with representations of a deck of cards, the deck of cards including a predetermined jackpot card representation, and for the at least one player optionally to participate in jackpot play for a jackpot, comprising: receiving a selection from each of the at least one player whether to participate in the card game; receiving a selection from the each of the at least one card game player whether to participate in the jackpot play; assigning at least one representation of a card from the representations of the deck of cards to each player; for each player participating in the jackpot play, determining whether the predetermined jackpot card representation was assigned; and if at least one player participating in the jackpot play was assigned the predetermined jackpot card representation, awarding the jackpot to the one player participating in the jackpot play assigned the predetermined jackpot card representation.

To achieve the stated and other advantages of the present invention, as embodied and described below, the invention further includes a gaming table for at least one player to play a card game with a deck of cards, the deck of cards including a predetermined jackpot card, and for the at least one player optionally to participate in jackpot play for a jackpot, the gaming table comprising: a table surface; at least one player location indicated on the table surface, each of the at least one player location including: an indicated ante location; and an indicated jackpot play bet location; and a dealer location indicated on the table surface; wherein a selection is received from each player whether to participate in the game, the selection including placing an ante wager at the indicated ante location; wherein a selection is received from the each of the at least one card game player whether to participate in the jackpot play, the selection including placing a wager at the indicated jackpot play bet location; wherein at least one card is dealt from the deck of cards to each of the at least one card game player; wherein a determination is made as to whether each of the at least one card game player participating in the jackpot play was dealt the predetermined jackpot card; and wherein, if one of the at least one card game player participating in the jackpot play was dealt the predetermined jackpot card, the jackpot is awarded to the one of the at least one card game player participating in the jackpot play dealt the predetermined jackpot card.

To achieve the stated and other advantages of the present invention, as embodied and described below, the invention further includes a device for a player to play a card game with representations of a deck of cards, the deck of cards including a predetermined jackpot card, and for the at least one player optionally to participate in jackpot play for a jackpot, the device comprising: a display for displaying the card game, including the representations of a deck of cards; and a processor for receiving selections from the player for play of the game, for determining progress of play, and for processing and displaying a graphical user interface; wherein a selection is received from each of the at least one player whether to participate in the card game; wherein a selection is received from the each of the at least one card game player whether to participate in the jackpot play; wherein at least one representation of a card from the representations of the deck of cards is assigned to each player; wherein, for each player participating in the jackpot play, the processor determines whether the predetermined jackpot card representation was assigned; and wherein, if at least one player participating in the jackpot play was assigned the predetermined jackpot card representation, the jackpot is awarded to the one player participating in the jackpot play assigned the predetermined jackpot card representation.

Additional advantages and novel features of the invention will be set forth in part in the description that follows, and in part will become more apparent to those skilled in the art upon examination of the following or upon learning by practice of the invention.

BRIEF DESCRIPTION OF THE FIGURES

In the drawings:

FIGS. 5A–5B show a flow diagram of an example method of play for the present invention that includes an underlying card game in accordance with an embodiment of the present invention.

DETAILED DESCRIPTION

Figure 1:
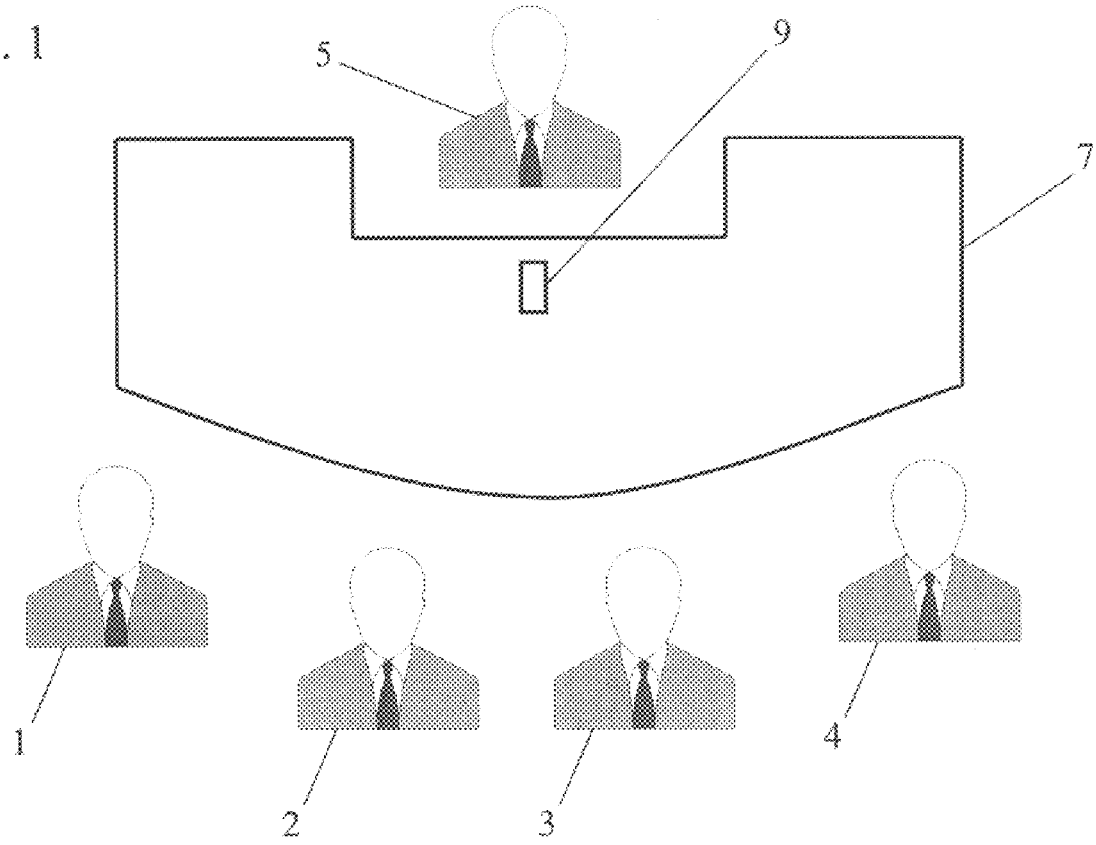
FIG. 1 is an overhead view of the players, dealer, and gaming table for play of the game in accordance one embodiment of the present invention.

An embodiment of the present invention includes an auxiliary bonus jackpot feature that participating players in an underlying game, such as a casino style card game, are able to win upon receiving a predesignated card or other random designation for winning.

In accordance with an embodiment of the present invention, play is conducted using one or more standard sets of 52 playing cards having values of Ace, 2, 3, 4, 5, 6, 7, 8, 9, 10, Jack, Queen, and King, optionally with the addition of one or more Jokers. The game is optionally played with the Ace as the high or low card, or as optionally selectable as high or low by each player. Each participating player is seated at, for example, a playing table, as described further below, on the players' side of the table. The dealer is located on the dealer's side of the table, opposite the players. In one embodiment, the table is curved, having a convex side and an opening for the dealer, so that the dealer is easily able to deal to each player from the dealer opening in the table, and up to seven players are easily and comfortably accommodated on the convex side of the table.

The game may also be played with representations of any of the features described. For example, the game is playable in an electronic or partially electronic manner using a terminal, such as a personal computer, microcomputer, minicomputer, mainframe computer, or other device having a processor and display, such as an electronic hand-held game device, for which representative images of cards are displayable on a screen via a graphical user interface (GUI). The game is also playable in conjunction with performance of selected functions on a network, such as the Internet or an intranet or using, for example, a slot machine or other device.

In play of the game, before any cards are dealt to begin play of the underlying game or the underlying game otherwise begins, each player decides whether to participate in the auxiliary bonus portion of the game. In an embodiment of the present invention, each player indicates a decision to play in the auxiliary bonus portion by placing a special bonus bet, such as in conjunction with placing an ante for an underlying card game. In an embodiment played in conjunction with use of a gaming table, each player places the special bonus bet in a special bonus bet spot location for that player and places the ante in a special ante spot location. The minimum and maximum bets for the special bonus bet are determinable by the rules of the house, or, for example, by agreement among the players and the house or dealer.

After each player has determined whether or not to play and all special bonus bets have been placed, the dealer cuts the cards or alternatively shuffles and cuts the cards if the game is being played with a single deck of cards. The game is also playable with multiple decks of cards using, for example, a card shoe, in which multiple decks are held and cards are dealt one at a time by removal from the shoe.

Typically, particularly if played with a single deck, the dealer begins by placing the top card to one side as a security measure. Cards are then dealt one at a time to each player in turn, such that each player has the appropriate cards for the game played. The dealer also deals cards to the dealer position if the underlying game includes such play. For example, if the underlying game is Blackjack, each player and the dealer are sequentially dealt hands, the player cards typically being dealt face up and the dealer's cards face down. For five card Draw Poker, each player or each player and the dealer are initially dealt five cards sequentially face down. For five card Stud Poker, each player or each player and the dealer are initially dealt one card face down, three cards face up, and a fifth card face down. Other underlying card games or other games are played consistent with the rules of those games.

If any player receives the predesignated card, such as the Joker, or other indication for winning the jackpot, such as electronic indication, and that player selected to play in the auxiliary bonus portion of the game, that player receives the jackpot. The determination of whether the player has received the card is made, for example, by the dealer noting or indicating that the predetermined card has been dealt face up to a player, or by the player receiving the card revealing the card to the dealer, particularly if the card is dealt face down. If no player receives the predesignated indication for winning the jackpot, or if a player in the underlying game who selected not to participate in the auxiliary bonus portion of the game receives the predesignated indication for winning, no jackpot is awarded and the jackpot carries over until the next round of play of the underlying game. Similarly, if the predesignated indication is received by the Dealer or appears as, for example, a community card in card games including such play, no jackpot is awarded and the jackpot carries over until the next round. In play in which the predesignated card or other indication is received by a player selecting not to participate in the auxiliary bonus portion of the game, is received by the Dealer, or appears as a community card, the predesignated card or other indication is discarded, and another card is dealt in its place or other replacement play made. Similarly, for players winning the jackpot, the predesignated card is discarded after the jackpot is paid, and a substitute card is dealt to the winning player. Thus, the predetermined card is not used for play in the card game.

The minimum and maximum bets for the special bonus jackpot are determinable by the rules of the house, or for example, by agreement among the players and the house or dealer.

The game table used in conjunction with one embodiment of the present invention is a standard Blackjack or Poker sized casino table, in which a dealer occupies one side of the table and players occupy the other. In one embodiment, the table includes a bar located on the dealer's side of the table. The table also includes the name of the game, "Bonus Jackpot."

From the player's side, below the name (toward the players), are player positions for up to seven player spots. At each player's position are two betting spots or areas, one of which is marked "ante" and the other marked "Bonus Jackpot." At these betting spots, players place chips for betting as play of the game proceeds. In an embodiment of the present invention, the ante spot is used for selection by players to play in the underlying card game, and the "Bonus Jackpot" spot is used by players to select to participate in the "Bonus Jackpot."

During the play of the game, selected cards are dealt by the dealer to each player in each respective player's area. In an embodiment of the present invention, marked lines, such as red or red and white lines, are included on the table to clearly delineate each player's position from an adjacent player or players. The clear separation of each player position by the lines serves a number of functions, including preventing cheating, by clearly indicating the area in which a player's money or chips are located.

References will now be made in detail to embodiments of the present invention, examples of which are illustrated in the accompanying drawings.

FIG. 1 is an overhead view of the players, dealer, and gaming table for play of the game in accordance one embodiment of the present invention. FIG. 1 shows an embodiment of the game as played with one to seven players 1, 2, 3, 4 and a dealer 5 at a gaming table 7 using one or more decks of cards located at a card location 9.

Figure 2:
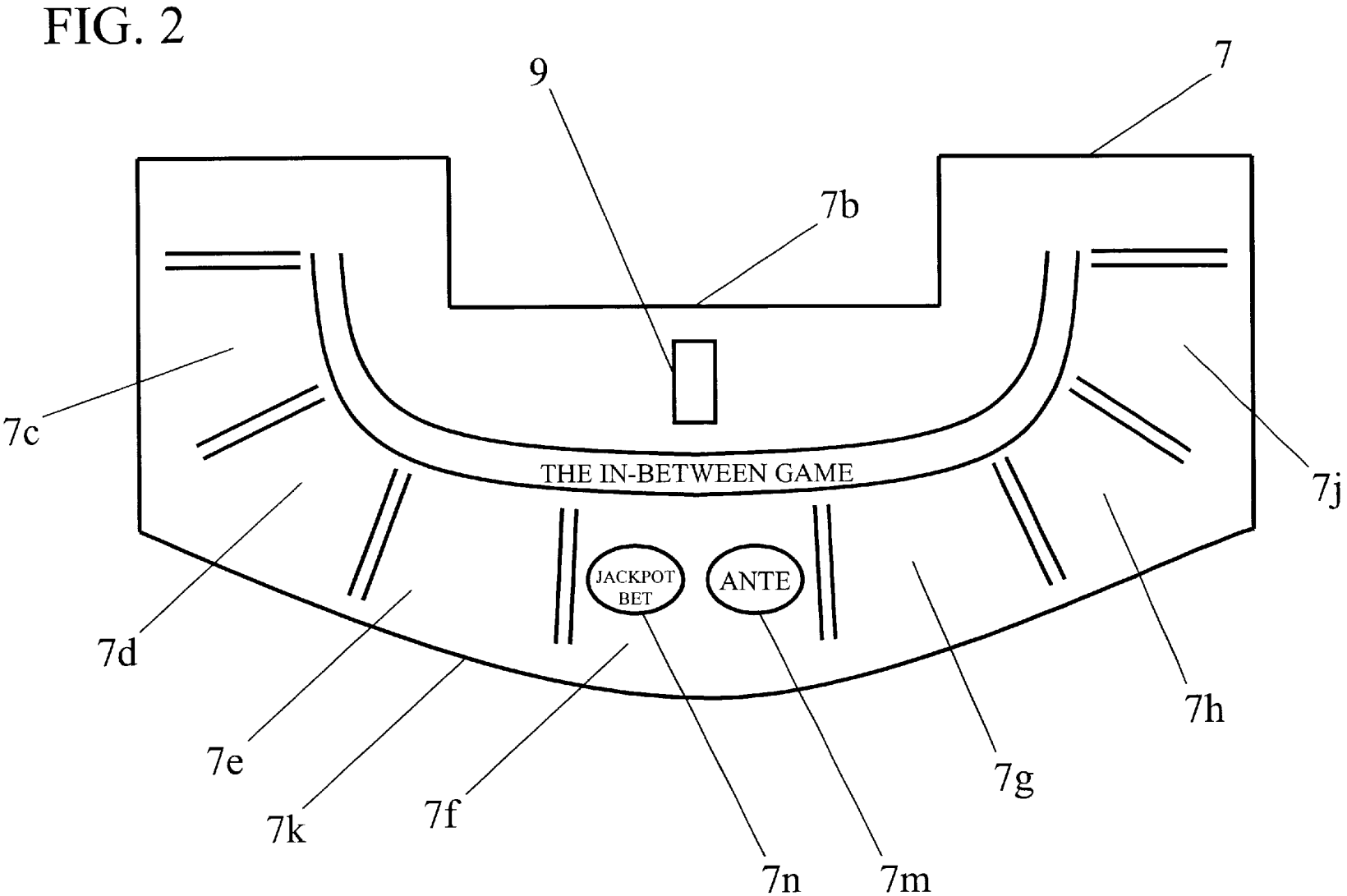
FIG. 2 presents a gaming table layout for a gaming table in accordance with an embodiment of the present invention.

FIG. 2 presents a gaming table layout for a gaming table in accordance with the embodiment of the present invention for play by players and a dealer at a gaming table. As shown in FIG. 2, the table 7 includes a deck placement area 9 on the dealer side of the table 7*b* and seven player areas 7*c*, 7*d*, 7*e*, 7*f*, 7*g*, 7*h*, 7*j* on the players' side of the table 7*k*. Each player area 7*c*, 7*d*, 7*e*, 7*f*, 7*g*, 7*h*, 7*j* includes two marked areas, an ante spot 7*m*, for placement of an ante wager, and a jackpot bet spot 7*n*, for placement of a jackpot wager.

Figure 3:
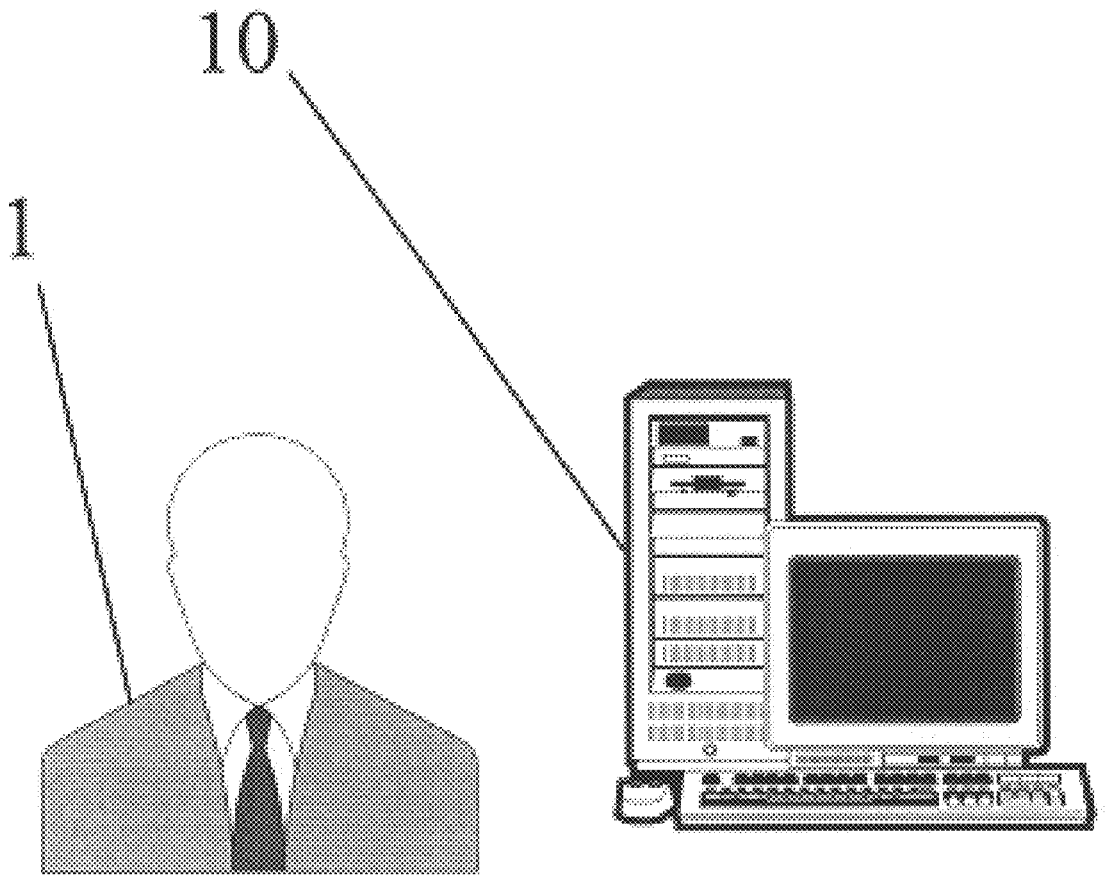
FIG. 3 depicts the components for electronic play of the game in accordance with one embodiment of the present invention.

FIG. 3 depicts the components for electronic play of the game in accordance with one embodiment of the present invention. As shown in FIG. 3, in this embodiment, the player 1 plays at a terminal 10, such as a personal computer, a minicomputer, a microcomputer, a main frame computer, or other device having a display, processor, and GUI, including a hand-held electronic game.

Figure 4:
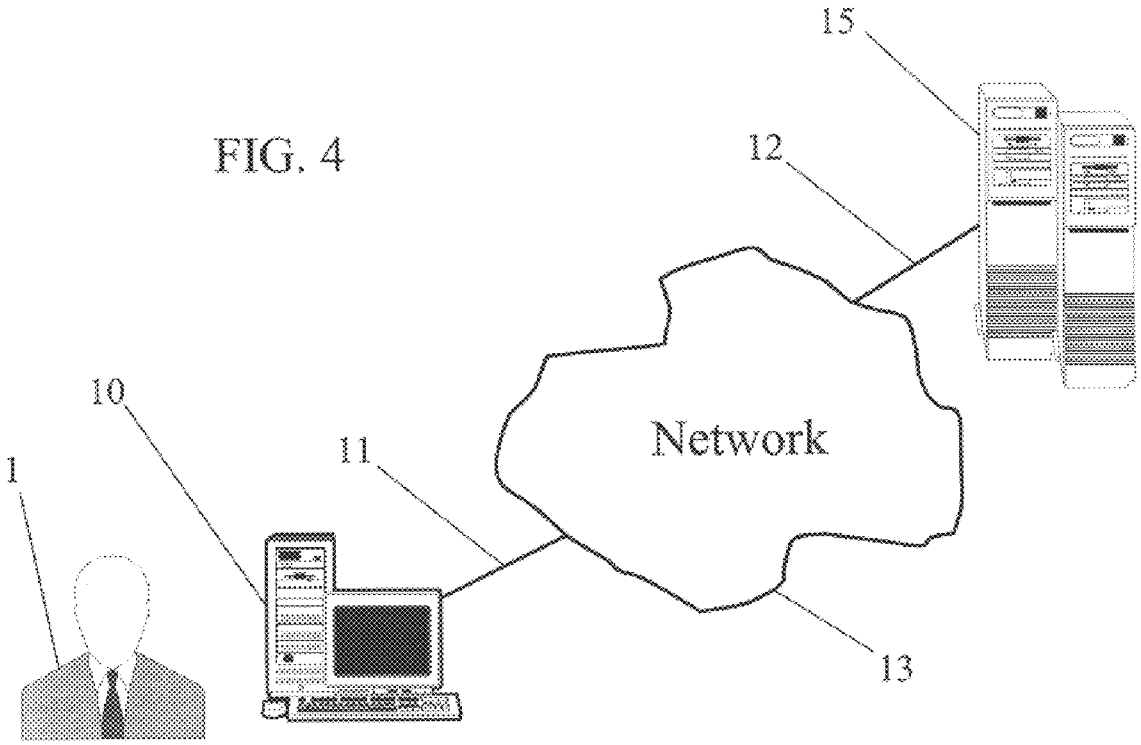
FIG. 4 presents components for electronic play of the game via a network in accordance with another embodiment of the present invention.

FIG. 4 presents components for electronic play of the game using a network, such as the Internet or an intranet, in accordance with another embodiment of the present invention. As shown in FIG. 4, a player 1 plays at a terminal 10, such as a personal computer, a minicomputer, a microcomputer, a main frame computer, or other device having a display and processor. The terminal 10, is connected 11, 12 via, for example, wire, wireless, or fiberoptic coupling to a network 13, such as the Internet or an intranet, to a server 15, such as personal computer, a minicomputer, a microcomputer, a main frame computer, or other device having a processor.

Figure 5A:
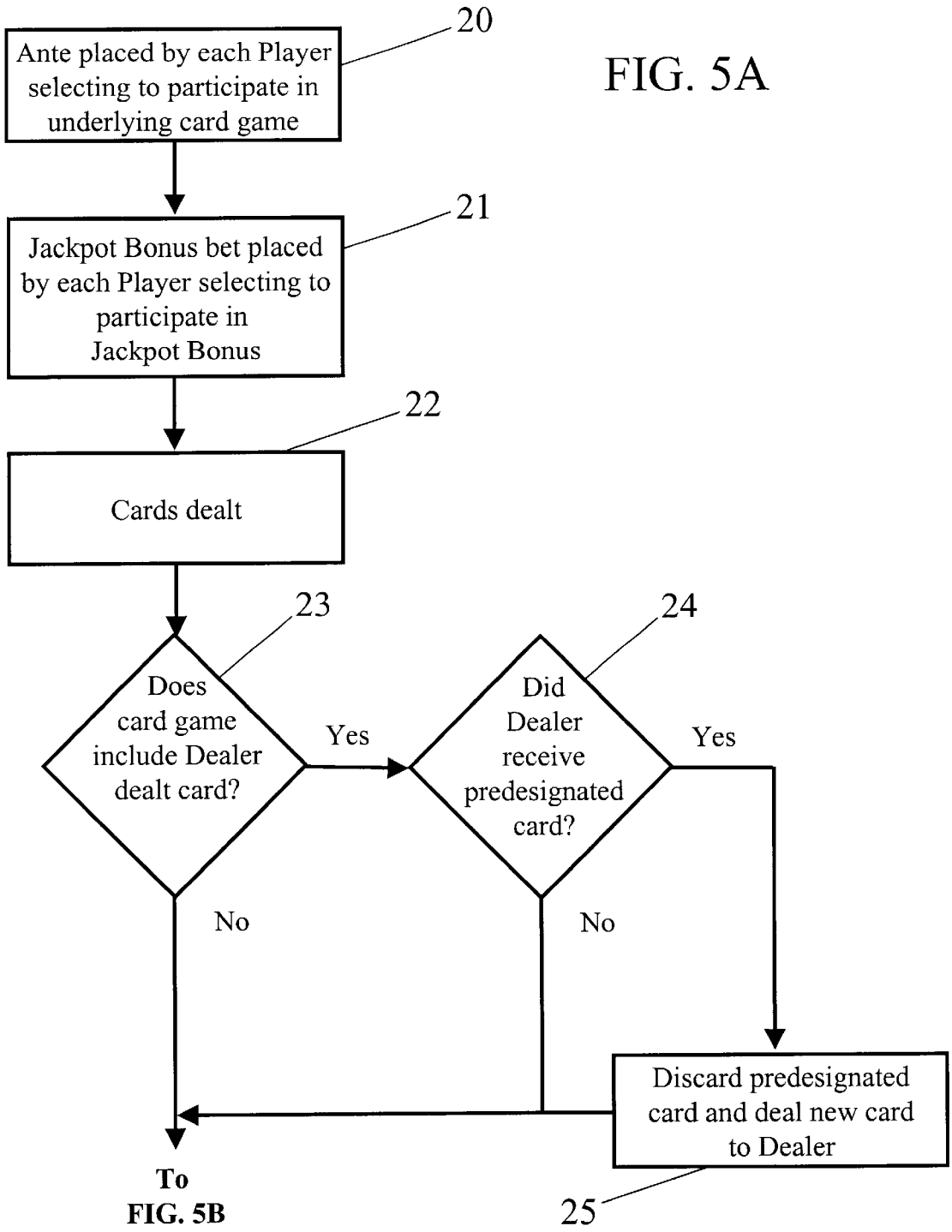

FIGS. 5A–5B show a flow diagram of an example method of play for the present invention that includes an underlying card game in accordance with an embodiment of the present invention. As shown in FIGS. 5A and 5B, play of the game begins with an ante placed by each Player selecting to participate in the underlying card game 20. The ante can be placed, for example, by the Player positioning a wager in the ante area for that player on a gaming table or, for example, by selecting an option on a terminal. A Jackpot Bonus bet is then placed by each Player who placed and ante and who selects to participate in the Jackpot Bonus portion of the game 21. Cards are then dealt 22.

A determination is then made as to whether the underlying card game includes dealing of one or more cards to the Dealer 23. The determination may be made, for example, by the Dealer, for a card game played on a gaming table, or, for example, by a processor, for a game played on a terminal. If the Dealer is dealt cards in accordance with the underlying card game, a determination is made as to whether the dealer received a predetermined card, such as the Joker added to the deck 24. If the dealer was dealt the predetermined card, that card is discarded, and a substitute card is dealt to the Dealer 25.

As shown in FIG. 5B, a determination is then made as to whether the underlying card game includes play with one or more community cards 26. If one or more community cards are dealt, a determination is made as to whether the predetermined card was dealt as a community card 27. If the predesignated card was dealt as a community card, that card is discarded, and a substitute card is dealt as a community card 28.

A determination is then made as to whether any Player was dealt the predesignated card 29. If no Player was dealt a predesignated card, no Jackpot Bonus is awarded for this round of the underlying card game, the Jackpot carries over to the next round of play 30, and play of the underlying game continues for the next round with antes being placed by Players 20. If a Player was dealt the predesignated card, a determination is made as to whether that Player selected to participate in the Jackpot Bonus portion of the game 31. If that Player did not select to participate in the Jackpot Bonus portion of the game, the predesignated card is discarded, a substitute card is dealt to that Player 32, and no Jackpot Bonus is awarded for this round of the underlying game 30. If the Player receiving the preselected card did select to participate in the Jackpot Bonus portion of the game, that Player is awarded the Jackpot Bonus 33, and play of the underlying game continues for the next round with antes being placed by Players 20.

Example embodiments of the present invention have now been described in accordance with the above advantages. It will be appreciated that these examples are merely illustrative of the invention. Many variations and modifications will be apparent to those skilled in the art.

What is claimed is:

1. A method for at least one player to play a card game with a deck of cards, the deck of cards including a predetermined jackpot card, and for the at least one player optionally to participate in jackpot play for a jackpot, comprising:

receiving a selection from each of the at least one player whether to participate in the card game;

receiving a selection from the each of the at least one card game player whether to participate in the jackpot play;

dealing at least one card from the deck of cards to each of the at least one card game player;

determining whether each of the at least one card game player participating in the jackpot play was dealt the predetermined jackpot card;

if one of the at least one card game player participating in the jackpot play was dealt the predetermined jackpot card, awarding the jackpot to the one of the at least one card game player participating in the jackpot play dealt the predetermined jackpot card;

dealing a dealer at least one card from the deck of cards;

determining whether the dealer was dealt the predetermined jackpot card; and if the dealer was dealt the predetermined jackpot card, discarding the predetermined jackpot card and dealing a substitute card to the dealer from the deck of cards.

2. A method for at least one player to play a card game with a deck of cards, the deck of cards including a predetermined jackpot card, and for the at least one player optionally to participate in jackpot play for a jackpot, comprising:

receiving a selection from each of the at least one player whether to participate in the card game;

receiving a selection from the each of the at least one card game player whether to participate in the jackpot play;

dealing at least one card from the deck of cards to each of the at least one card game player;

determining whether each of the at least one card game player participating in the jackpot play was dealt the predetermined jackpot card;

if one of the at least one card game player participating in the jackpot play was dealt the predetermined jackpot card, awarding the jackpot to the one of the at least one card game player participating in the jackpot play dealt the predetermined jackpot card dealing at least one card from the deck of cards as a community card;

determining whether the community card is the predetermined jackpot card; and if the community card is the predetermined jackpot card, discarding the predetermined jackpot card and dealing a substitute card from the deck of cards as a substitute community card.

3. A method for at least one player to play a card game with a deck of cards, the deck of cards including a predetermined jackpot card, and for the at least one player optionally to participate in jackpot play for a jackpot, comprising:

receiving a selection from each of the at least one player whether to participate in the card game;

receiving a selection from the each of the at least one card game player whether to participate in the jackpot play;

dealing at least one card from the deck of cards to each of the at least one card game player;

determining whether each of the at least one card game player participating in the jackpot play was dealt the predetermined jackpot card;

if one of the at least one card game player participating in the jackpot play was dealt the predetermined jackpot card, awarding the jackpot to the one of the at least one card game player participating in the jackpot play dealt the predetermined jackpot card; and if one of the at least one card game player not participating in the jackpot play was dealt the predetermined jackpot card, discarding the predetermined jackpot card and dealing a substitute card from the deck of cards to the one of the at least one card game player not participating in the jackpot play.

4. A method for playing a card game with representations of a deck of cards, the deck of cards including a predetermined jackpot card representation, and for the at least one player optionally to participate in jackpot play for a jackpot, comprising:

receiving a selection from each of the at least one player whether to participate in the card game;

receiving a selection from the each of the at least one card game player whether to participate in the jackpot play;

assigning at least one representation of a card from the representations of the deck of cards to each player;

for each player participating in the jackpot play, determining whether the predetermined jackpot card representation was assigned;

if at least one player participating in the jackpot play was assigned the predetermined jackpot card representation, awarding the jackpot to the one player participating in the jackpot play assigned the predetermined jackpot card representation; and if one of the at least one card game player was dealt the predetermined jackpot card, dealing an additional card to the player dealt the predetermined jackpot card.

5. A gaming table for at least one player to play a card game with a deck of cards, the deck of cards including a predetermined jackpot card, and for the at least one player optionally to participate in jackpot play for a jackpot, the gaming table comprising:

a table surface;

least one player location indicated on the table surface, each of the at least one player location including:
an indicate ante location; and
an indicated jackpot play be location; and a dealer location indicated on the table surface;

wherein a selection is received from each player whether to participate in the game, the selection including placing an ante wager at the indicated ante location;

wherein a selection is received from the each of the at least one card game player whether to participate in the jackpot play, the selection including placing a wager at the indicated jackpot play bet location;

wherein at least one card is dealt from the deck of cards to each of the at least one card game player;

wherein a determination is made as to whether each of the at least one card game player participating in the jackpot play was dealt the predetermined jackpot card;

wherein, if one of the at least one card game player participating in the jackpot play was dealt the predetermined jackpot card, the jackpot is awarded to the one of the at least one card game player participating in the jackpot play dealt the predetermined jackpot card; and wherein, if one of the at least one card game player was dealt the predetermined jackpot card, dealing an additional card to the player dealt the predetermined jackpot card.

6. A method for playing a card game with representations of a deck of cards, the deck of cards including a predetermined jackpot card representation, and for the at least one player optionally to participate in jackpot play for a jackpot, comprising:

receiving a selection from each of the at least one player whether to participate in the card game;

receiving a selection from the each of the at least one card game player whether to participate in the jackpot play;

assigning at least one representation of a card from the representations of the deck of cards to each player;

for each player participating in the jackpot play, determining whether the predetermined jackpot card representation was assigned;

if at least one player participating in the jackpot play was assigned the predetermined jackpot card representation, awarding the jackpot to the one player participating in the jackpot play assigned the predetermined jackpot card representation; and if one of the at least one card game player was dealt the predetermined jackpot card, dealing an additional card to the player dealt the predetermined jackpot card.

7. The method of claim 6, wherein receiving a selection from each of the at least one player whether to participate in the card game includes receiving an ante.

8. The method of claim 6, wherein receiving a selection from the each of the at least one card game player whether to participate in the jackpot play includes receiving a jackpot play bet.

9. The method of claim 6, wherein the jackpot play bet is added to the jackpot.

10. The method of claim 6, further comprising:

if no jackpot is awarded, carrying over the jackpot to another round of the play of the card game.

11. The method of claim 6, wherein the deck of cards includes at least one added Joker.

12. The method of claim 9, wherein the predetermined card is the at least one added Joker.

13. The method of claim 6, wherein the card game comprises one selected from a group consisting of Draw Poker, Five Card Stud Poker, Seven Card Stud Poker, and Blackjack.

14. The method of claim 6, wherein the card game includes a plurality of rounds, each of the rounds including dealing of at least one card to the at least one player, and wherein the predetermined jackpot card remains unchanged throughout play of the card game.

15. A device for a player to play a card game with representations of a deck of cards, the deck of cards including a predetermined jackpot card, and for the at least one player optionally to participate in jackpot play for a jackpot, the device comprising:

a display for displaying the card game, including the representations of a deck of cards; and processor for receiving selections from the player for play of the game, for determining progress of play, and for processing and displaying a graphical user interface;

wherein a selection is received from each of the at least one player whether to participate in the card game;

wherein a selection is received from the each of the at least one card game player whether to participate in the jackpot play;

wherein at least one representation of a card from the representations of the deck of cards is assigned to each player;

wherein, for each player participating in the jackpot play, the processor determines whether the predetermined jackpot card representation was assigned;

wherein, if at least one player participating in the jackpot play was assigned the predetermined jackpot card representation, the jackpot is awarded to the one player participating in the jackpot play assigned the predetermined jackpot card representation; and wherein, if one of the at least one card game player was dealt the predetermined jackpot card, dealing an additional card to the player dealt the predetermined jackpot card.

16. The device of claim 15, wherein the device comprises a terminal.

17. The device of claim 15, wherein the device comprises at least one terminal on a network.

18. The device of claim 16, further comprising a server on the network.

19. The device of claim 17, wherein the at least one terminal and the server are coupled via a coupling.

20. The device of claim 18, wherein the coupling comprises one from a group consisting of a wired connection, a wireless connection, and a fiberoptic connection.

21. The device of claim 17, wherein the at least one terminal comprises one selected from a group consisting of a personal computer, a minicomputer, a microcomputer, a main frame computer, and a telephone device.

22. The device of claim 17, wherein the server comprises one selected from a group consisting of a personal computer, a minicomputer, a microcomputer, and a main frame computer.

23. The device of claim 17, wherein the network is the Internet.

* * * * *